US006471139B1

(12) United States Patent
Bruder et al.

(10) Patent No.: US 6,471,139 B1
(45) Date of Patent: Oct. 29, 2002

(54) RAIL ARRANGEMENT

(75) Inventors: Michael Bruder; Michail Rabkin, both of Hamburg; Karl-Heinz Krause, Chemnitz; Edgar Böhm; Gerhard Merkmann, both of Gotha; Peter Schwob, Günthersleben; Klaus Tübel, Gotha, all of (DE)

(73) Assignee: Phoenix Aktiengesellschaft, Hamburg (DE)

( * ) Notice: Subject to any disclaimer, the term of this patent is extended or adjusted under 35 U.S.C. 154(b) by 0 days.

(21) Appl. No.: 09/445,840

(22) PCT Filed: May 28, 1998

(86) PCT No.: PCT/DE98/01460

§ 371 (c)(1),
(2), (4) Date: Dec. 14, 1999

(87) PCT Pub. No.: WO98/58125

PCT Pub. Date: Dec. 23, 1998

(30) Foreign Application Priority Data

Jun. 18, 1997 (DE) ..... 197 25 638
Oct. 7, 1997 (DE) ..... 197 44 147

(51) Int. Cl.[7] ..... E01B 9/00

(52) U.S. Cl. ..... 238/283; 238/281; 238/264; 238/306

(58) Field of Search ..... 238/310, 282, 238/283, 331, 348, 349, 351, 315, 316, 338, 339–343, 346, 347, 352, 354, 355, 377, 382, 287, 264, 265, 306, 307

(56) References Cited

U.S. PATENT DOCUMENTS 1,792,620 A * 2/1931 Wells ..... 238/283
3,351,283 A * 11/1967 Paasche et al. ..... 238/283
4,208,011 A * 6/1980 Dahlhaus et al. ..... 238/281
4,254,908 A * 3/1981 Matsubara ..... 238/283
4,266,719 A * 5/1981 Ortwein et al. ..... 238/283
4,771,944 A * 9/1988 Brister et al. ..... 238/283
4,907,740 A * 3/1990 Oberweiler et al. ..... 238/238
4,925,094 A * 5/1990 Buekett ..... 238/265
4,971,247 A * 11/1990 Harkus ..... 238/283
5,203,502 A * 4/1993 Young ..... 238/283
5,361,986 A * 11/1994 Meier et al. ..... 238/283
5,692,677 A * 12/1997 Duconseil ..... 238/283
5,735,457 A * 4/1998 Bohm et al. ..... 238/283

FOREIGN PATENT DOCUMENTS

DE EP0541884 5/1993
DE EP0632164 1/1995
DE 19504937 8/1995

* cited by examiner

*Primary Examiner*—S. Joseph Morano
*Assistant Examiner*—Lars A. Olson
(74) *Attorney, Agent, or Firm*—Collard & Roe, P.C.

(57) ABSTRACT

The invention relates to a rail arrangement for a rail superstucture such as a fixed railroad, comprising an elastic intermediate plate (3) which is located between the rail foot and a hard support (6) in the form of a concrete tie and has two through holes for the screws (7) to fasten the rails. For series mounting, which is the solution of choice, the elastic intermediate plate (3) is combined with an elastic intermediate layer (1) in such a way that the additional intermediate layer rests above the intermediate plate directly below the rail foot, whereby the intermediate layer (1) is separated from the intermediate plate (3) by a metal base plate (2) which serves to fasten the rail. According to the invention, the intermediate plate (3) consists of a single-piece vulcanisate made of a rubber mixture and has three structural zones related to a novel arrangement of protrusions (active surfaces) and recesses (inactive surfaces), whereby the inactive surfaces in the central zone are deeper than those in the two side zones. The invention also relates to other constructional features of the elastic intermediate plate (3).

31 Claims, 5 Drawing Sheets

RAIL ARRANGEMENT

CROSS REFERENCE TO RELATED APPLICATIONS

Applicants claim priority under 35 U.S.C. §119 of German Application Nos. 197 25 638.4 and 197 44 147.5 filed Jun. 18, 1997 and Oct. 7, 1997, respectively. Applicants also claim priority under 35 U.S.C. §120 of PCT/DE98/01460 filed May 28, 1998. The international application under PCT article 21(2) was not published in English.

BACKGROUND OF THE INVENTION

1. Field of the Invention

The invention relates to a rail arrangement for a rail superstructure such as a fixed railroad, comprising an elastic intermediate plate, which is located between the foot of the rail and a hard support (for example concrete support plates, steel ties, concrete ties), and which is provided in most cases with two through-extending holes for the screws to fasten the rails, whereby the elastic intermediate plate

- consists of a single-piece vulcanisate produced from a rubber mixture based on natural rubber (NR), epoxidized natural rubber (ENR), isoprene rubber (IR), butadiene rubber (BR), acrylate rubber (ACM), styrene-butadiene rubber (SBR), or mixtures of said types of rubber, in particular NR/SBR or NR/BR mixtures, as well as the usual mixture ingredients such as fillers, plasticizers, anti-aging agents as well as additional additives, if necessary;
- has a substantially plane surface, whereas its bottom side has an edge extending all around, said edge being provided in most cases with a drainage duct extending in the transverse direction relative to the rail, whereby the edge is a system of protrusions and recesses with a preferably substantially mirror-symmetric overall structure based on the center planes extending in the transverse and longitudinal directions of the rail, whereby the bottom side is in most cases seated on the hard support;
- and has three zones extending substantially parallel with the longitudinal direction of the rail, whereby the center zone has a different structure with respect to the system of protrusions and recesses than the two side zones having the same structure, in a way such that the center zones have greater rubber-elastic deformability than the two side zones.

2. The Prior Art

A similar rail arrangement is known from EP-A-0 541 884. It has been proposed in connection with said document, for example to provide the elastic intermediate plate with blind holes or zigzag-shaped grooves, whereby said elements forming the recesses occur more frequently within the center zone than within the two side zones, which leads to the fact that the center zone has greater rubber-elastic deformability than the two side zones.

Also, an elastic intermediate plate, provided with a protrusion system, is known from DE 195 04 937.

A considerable component of long-distance passenger rail traffic is already realized at the present time on so-called high-speed railroad lines in a number of countries, in particular in France, Japan and Germany. Due to the new construction of such railroad lines, which are being built within the framework of coupling national high-speed lines in Europe to form an international system, including at the same time long-distance freight railroad transport (mixed utilization of the railway lines), said development continues to make progress.

The expenditure to maintain and service such high-speed lines is justifiable and long-term utilization of such lines at low cost is possible only if such high-speed railway lines are built as so-called "fixed lanes" on earth structures and in tunnels and on bridges, as opposed to the classic crushed-stone ballast surface. Now, in order to obtain optimal riding comfort, low vibration and low noise molestation of the railwayside population, low dynamic stress for the railway lanes, and high availability of the railway tracks, the elastic intermediate plate has to satisfy the following requirements, namely:

- static secant stiffness Cstat=10 to 30 kN/mm, in particular 15 to 25 kN/mm (lower limit 15 kN, upper limit 50 kN); and
- dynamic stiffening factor æ≦2.5, in particular ≦1.5.

Taking into account the resistance to fatigue and the fatigue limit (useful life), said requirements can not be satisfied with a single-piece intermediate plate produced as a molded article based on TPE material. The values specified for Cstat as shown above with a compatible dynamic stiffening factor over the required useful life can not be achieved with a TPE material without distinctly increasing the structural height. Said requirements can be met only in connection with vulcanisates produced from a rubber mixture particularly with the use of the NR, ENR, IR, BR, ACM, SBR, NR/SBR or NR/BR types of rubber, including a suitable construction of the elastic intermediate plate.

SUMMARY OF THE INVENTION

The elastic intermediate plate as defined by the invention is characterized by the following constructional design features:

The recesses within the three zones are designed as inactive surfaces forming at the same time the bottom, the latter representing the closed limitation relative to the top side of the elastic intermediate plate, whereby the inactive surfaces within the center zone are disposed deeper than the ones located in the two side zones as well have within one zone a substantially constant depth.

The active surfaces of the protrusions within the center zone have a smaller overall surface than the ones of the protrusions within each of the side zones.

The two side zones each occupy a larger surface area than the center zone.

BRIEF DESCRIPTION OF THE DRAWINGS

Now, the invention is explained in greater detail in the following with the help of exemplified embodiments and by reference to the drawings, in which.

DETAILED DESCRIPTION OF THE PREFERRED EMBODIMENTS

Figure 1:
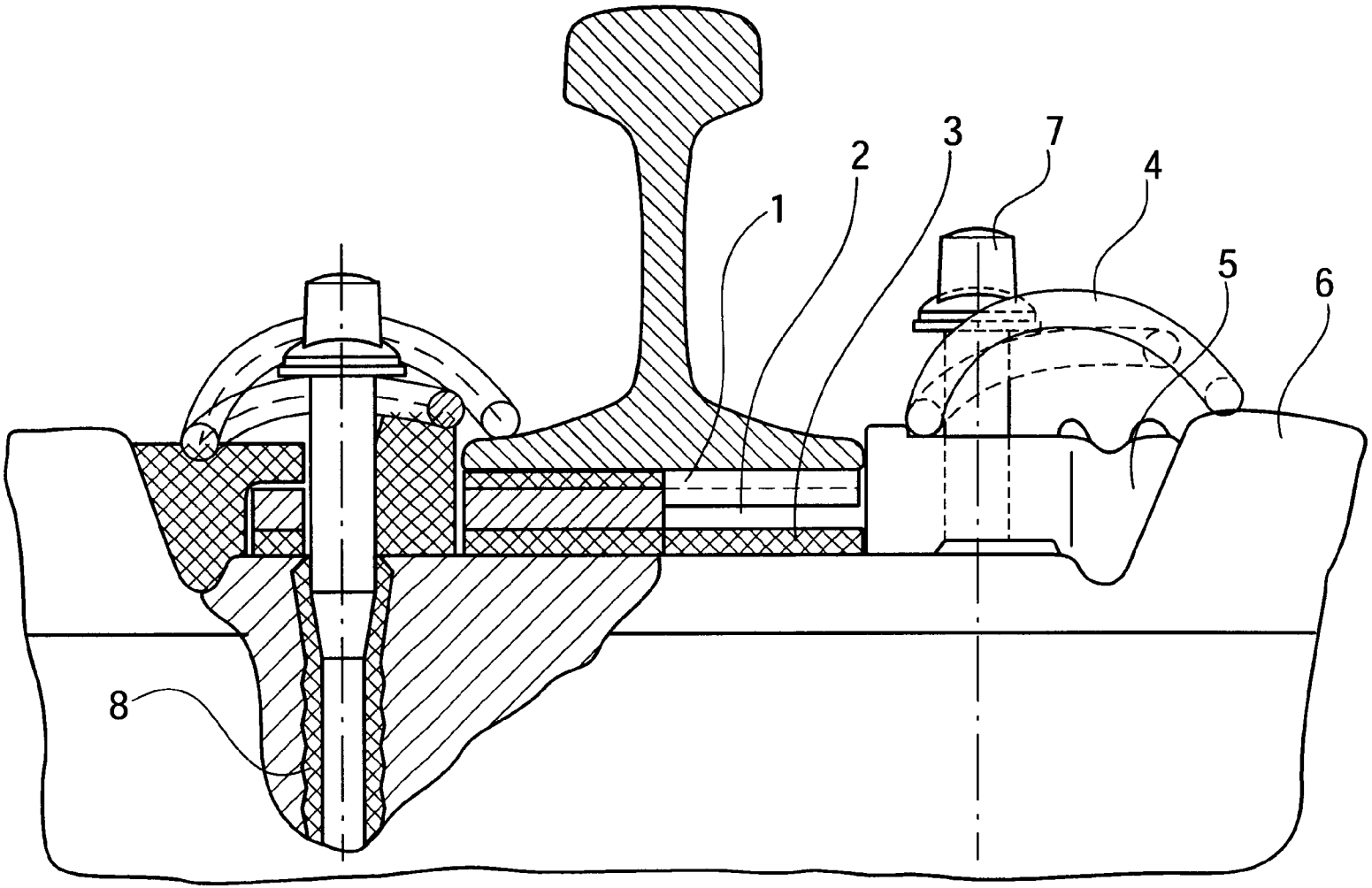
FIG. 1 shows a rail arrangement comprising a series arrangement consisting of an elastic intermediate layer and an elastic intermediate plate (sectional representation).

The following list of reference numerals and symbols applies in connection with figures:

1 Elastic intermediate layer
2 Base plate for securing the rail
3, 3' Elastic intermediate plate
4 Chucking clamp
5 Angle guide plate
6 Hard support in the form of a concrete tie (solidly combined with concrete sole by casting)
7 Tie screw
8 Screw dowel
9, 9' Edge (margin) extending all around
10, 10' Protrusion
11, 11' Protrusion
12, 12' Protrusion (multi-component, forming the parts 12*a*, 12*b*; 12'*a*, 12'*b*, 12'*c*)
13, 13' Protrusion
14, 14' Recess
15, 15' Recess
16, 16' Bore for fastening the rail
17, 17' Drain duct
18, 18' Drain duct
19 Bottom
20 Top side
A Side zone
B Center zone
X Center plane (in the transverse direction relative to the rail)
Y Center plane (in the longitudinal direction of the rail)
u Total thickness of the intermediate plate (total height of active surfaces)
v Depth of inactive surfaces within side zone A
v' Depth of inactive surfaces within center zone B
w Thickness of bottom within center zone B.

FIG. 1 shows a rail arrangement in connection with which the elastic intermediate plate 3 is combined within the framework of a series mounting with an elastic intermediate layer 1, in a way such that the additional intermediate layer comes to rest above the intermediate plate directly below the foot of the rail, whereby the intermediate layer 1 is separated from the intermediate plate 3 by a base plate 2 made of metal, said base plate serving for the fastening of the rail. The elastic intermediate layer 1 has about the width of the foot of the rail. As compared to the intermediate layer 1, the elastic intermediate plate 3 requires about twice as much surface area, whereby the following values apply with respect to the total thickness of said two elastomer systems:

Elastic intermediate layer 1: at least 7 mm;

Elastic intermediate plate 3: at least 10 mm.

The elastic intermediate plate 3, which directly sits on the hard support 6 (concrete tie), has breakthroughs for the screws 7 of the multi-component rail fastening.

Within the framework of an alternative design variation, the elastic intermediate plate 3 can be employed without the elastic intermediate layer 1 even if the series mounting is preferred.

With series mounting, it is advantageous, furthermore, if the resulting spring stiffness is always smaller than the lowest individual spring stiffness.

Now, before the elastic intermediate plate 3 as defined by the invention is addressed in greater detail it is necessary to mention the advantageous design variations of the elastic intermediate layer 1, which are described as follows:

The intermediate layer 1 consists of a single-piece vulcanisate particularly based on the same material as the intermediate plate 3. The rubber component of said layer amounts to 45 to 75% by weight, in particular 55 to 65% by weight.

The intermediate layer 1 has a substantially plane top side, whereas its bottom side has an edge extending all around, such edge being provided in most cases with at least one drain duct extending transversely relatively to the rail, whereby said edge includes a system of protrusions and recesses preferably with a substantially mirror-symmetric overall structure based on the center planes extending in the transverse and longitudinal directions of the rail. The recesses, which are forming inactive surfaces, have substantially the same depth everywhere, with a minimum depth of 3 mm. The active surfaces of the protrusions and the surface of the edge extending all around, furthermore, are designed in such a way that they form a substantially plane support surface in the unloaded condition.

In connection with the intermediate layer 1, the total surface area of all protrusions is ≧than the total surface area of the inactive surfaces of all recesses.

Figure 2:
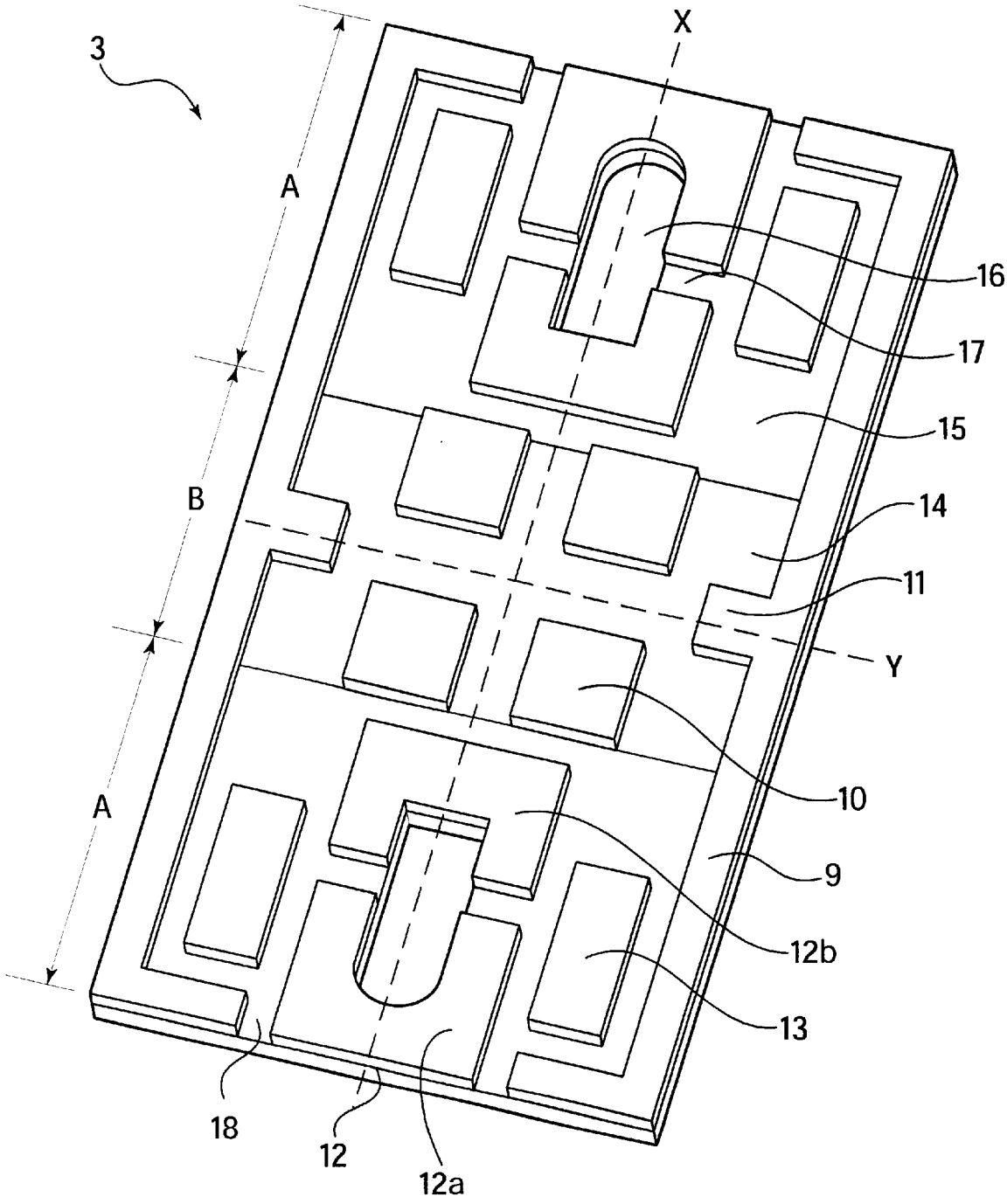
FIG. 2 shows the bottom side of an elastic intermediate plate (top view).

According to FIG. 2, the elastic intermediate plate 3 has three zones A and B, whereby the center zone has a different structure with respect to the system of protrusions and recesses than the two side zones A having the same structure; however, with a substantially mirror-symmetric overall structure based on the center planes X and Y extending in the transverse and longitudinal directions of the rail.

The edge 9 extending all around is provided with a total of four drain ducts 18 extending in the transverse direction of the rail, said ducts insuring that water which may have penetrated the system can drain off.

Edge 9, furthermore, comprises a system of protrusions and recesses. In said system, four protrusions are present within the center region of central zone B, said protrusions being arranged separated from one another. Furthermore, center zone B has two bridge-like protrusions 11, which are located within the region of the center plane Y extending in the longitudinal direction of the rail, and each connected with the edge 9 extending all around.

The two side zones A each have a large base protrusion 12, which is arranged in the region of the center plane X extending in the transverse direction of the rail, and connected with the edge 9 extending all around, whereby each base protrusion is provided with a breakthrough 16 for the screws of the rail fastening. Furthermore, each base protrusion is provided with two drain ducts 17 extending in the longitudinal direction of the rail and forming a two-component base protrusion 12*a* and 12*b*. An additional protrusion 13 is arranged between the base protrusion and the edge extending all around, said additional protrusion not being connected with the edge and having its greatest dimension of expanse in the transverse direction of the rail.

Figure 3:
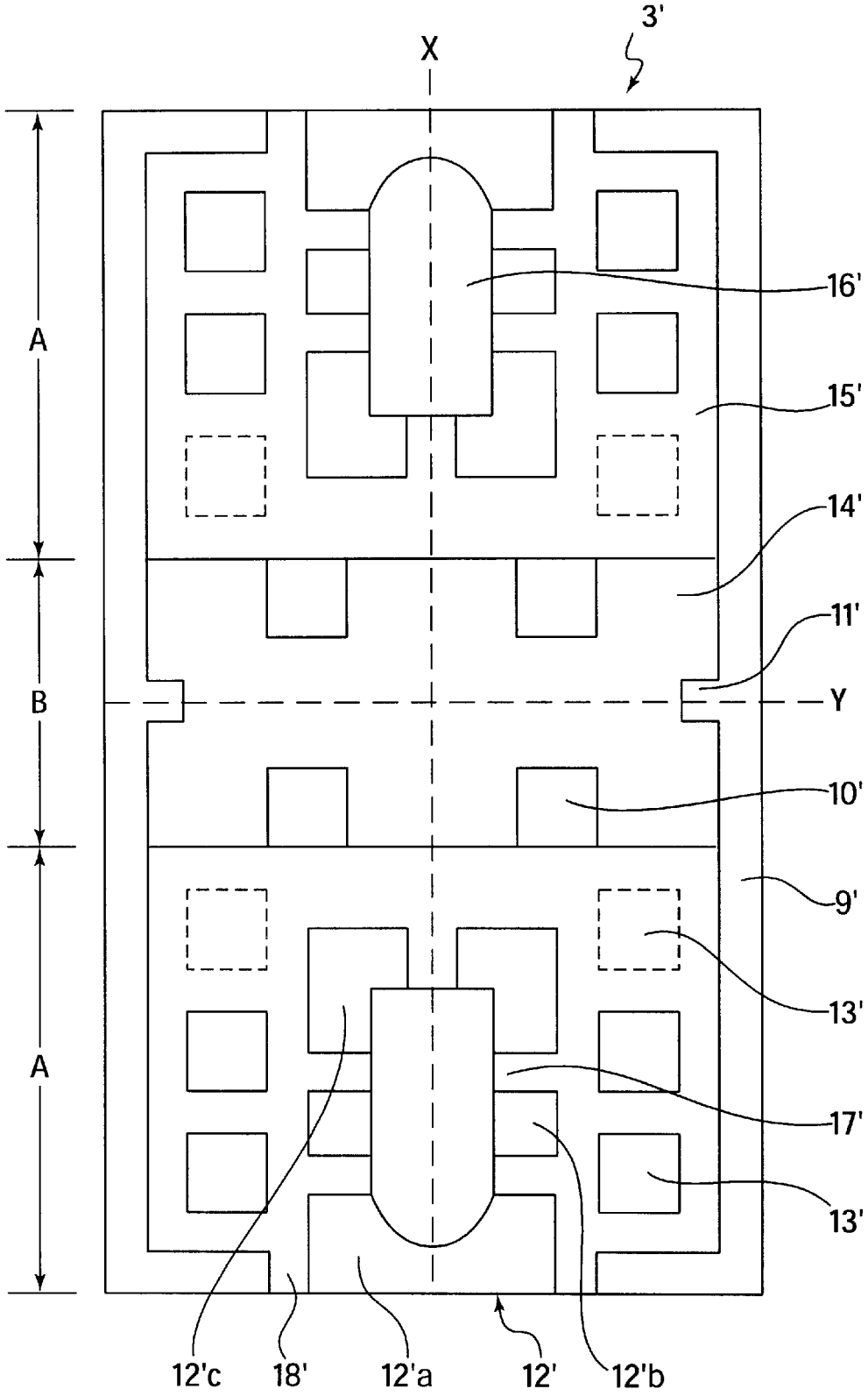
FIG. 3 shows the bottom side of another elastic intermediate plate (top view).

Now, FIG. 3 shows a modified elastic intermediate plate 3'. According to said figure, the active surfaces of the four central protrusions 10' and also the two bridge-like protrusions 11' within center zone B are designed substantially smaller than within the framework of the exemplified embodiment according to FIG. 2. At the same time, the inactive of the recess 14' is clearly enlarged here.

Concerning the constellation of the protrusions within the two side zones A, which have the same structure, said constellation is characterized in that the base protrusion 12' provided with a breakthrough 16' is provided here with a total of five drain ducts 17', forming a five-component base protrusion 12'*a*, 12'*b* and 12'*c*, on the one hand. On the other hand, two protrusions 13' are present here between the base protrusion and the edge 9' extending all around, said two protrusions being arranged separated from each other. A third protrusion 13' (dashed line) is present, if need be. The protrusions 13' within side zone A each have an active surface of the about the same size, such surfaces in turn having about the same size as the active surface of each protrusion 10' of center zone B.

The elastic intermediate plates 3, 3' according to FIGS. 2 and 3 are characterized by the following special constructional features:

The inactive surfaces of the recesses 14, 15 and 14', 15', respectively, within the three zones A,B at the same time form the bottom representing the closed limitation against the top side of the elastic intermediate plate, whereby the inactive surfaces within center zone B are disposed deeper than the two side zones A. Constructional details in this regard are explained below in greater detail in connection with FIG. 4.

The active surfaces of protrusions 10, 11, and 10', 11', respectively, within center zone B have a smaller overall surface than those of the protrusions 12, 13, and 12', 13', respectively, located within each side zone A. The edge 9, 9' extending all around is not taken into account in this view of the surface area.

The two side zones A each occupy a larger surface area than the center zone B, whereby the edge 9, 9' extending all around is included in the view of the surface area in the present case.

The overall or total surface area of the active surfaces of all protrusions 10, 11, 12, 13, and, respectively, 10', 11', 12', 13' within the three zones A, B is ≦of the total surface area of the inactive surfaces of all recesses 14, 15 and, respectively, 14', 15'within the three zones A, B.

The center zone B has a width smaller than the width of the foot of the rail, based on the transverse direction of the rail.

The active surfaces of the protrusions 10, 11,12,13, and, respectively, 10',11',12', 13' and the surface of the edge 9, 9', respectively, are designed in such a way that they form a substantially plane support surface in the unloaded condition.

Figure 4:
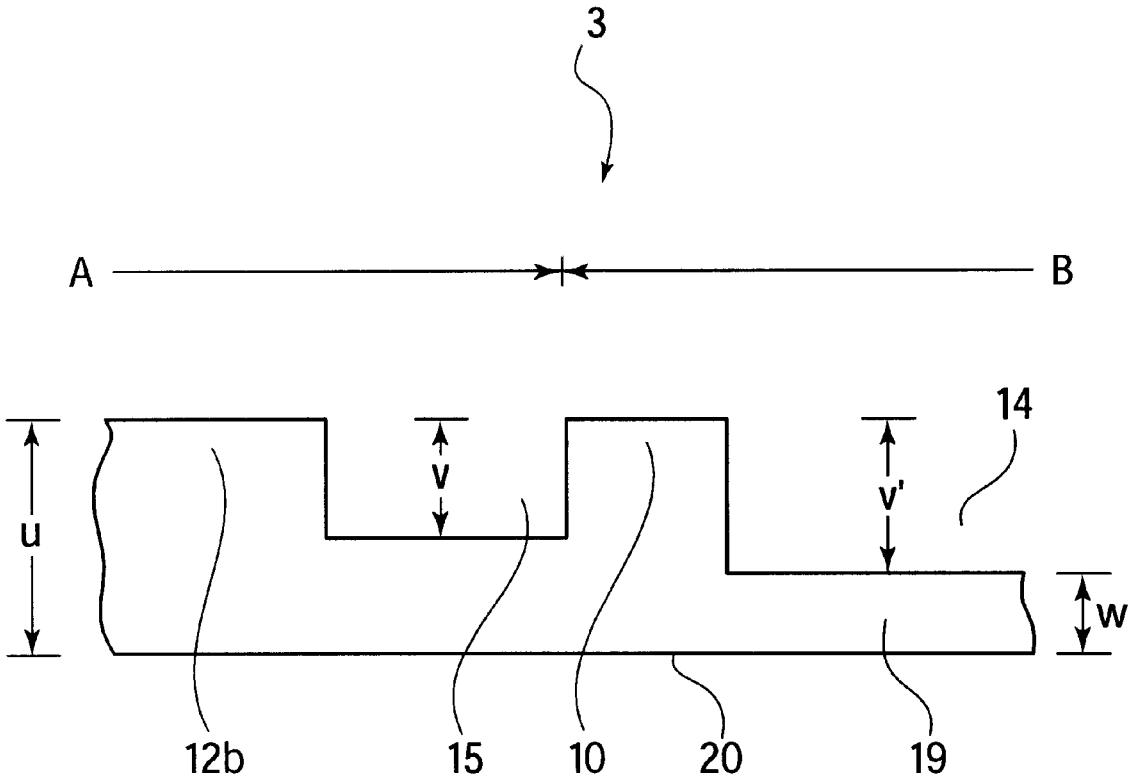
FIG. 4 shows the constructional parameters of the elastic intermediate plate (sectional view)

Now, FIG. 4 shows a few constructional parameters with the help of the elastic intermediate plate 3 according to FIG. 2. Said parameters are:

The total thickness u, based on the total height of the active surfaces of the protrusions 10 and 12*b,* amounts to at least 10 mm, in particular, however, to 10 to 12 mm.

The minimum depth v of the inactive surface of recess 15 within side zone A amounts to 3 mm, in particular 4 mm, at a substantially unchanging depth v.

The minimum depth v' of the inactive surface of recess 14 within the center zone B amounts to at least 1 mm, in particular at least 2 mm greater than the depth within side zone A, at a substantially unchanging depth v' in the present case as well.

The minimum thickness w of the bottom 19 between the inactive surface of recess 14 within center zone B, and the top side 20 amounts to 2 mm, in particular 3 mm.

Figure 5:
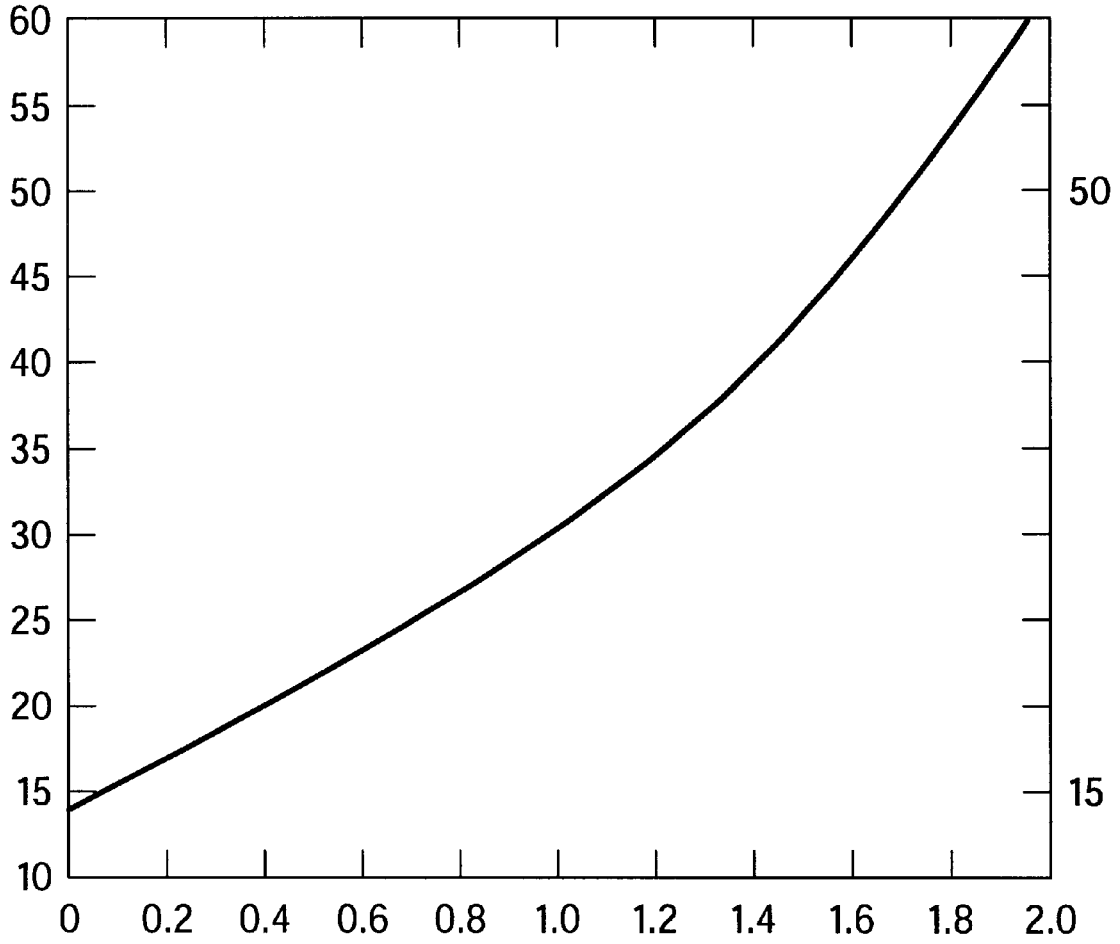
FIG. 5 is a force/displacement diagram for the purpose of determining the secant stiffness, measured on an elastic intermediate plate according to FIG. 3.

Now, FIG. 5 contains the results of measurements (average values of three measurements) on the elastic intermediate plate 3' according to FIG. 3, namely without the third protrusion 13' (dashed line), whereby the force [kN] is plotted on the ordinate, and the displacement on the abscissa [in mm]. The static secant stiffness is now measured based on the curve in the range of 15 kN (lower limit) and 50 kN (upper limit) and amounts to 20.3 kN/mm.

The elastic intermediate plate, on which said measurements were based, consisted of an NR/SBR mixture with a rubber component of 55 to 65% by weight. With a plate dimension of 160 mm by 290 mm, the width of the edge extending all around came to 10 mm. The following values applied with respect to the constructional parameters u, v, v' and w:

u =10 mm v =6 mm v'=8 mm w =2 mm.

The measured results clearly show that the value of the required secant stiffness as specified above is reached.

Furthermore, another test showed that the elastic intermediate plate also satisfies the above-specified profile of requirements with respect to the dynamic stiffening factor.

What is claimed is:

1. An elastic intermediate plate positioned between a rail base and a hard support of a rail track having a plurality of rails, which comprises:

a single-piece vulcanized material produced from a rubber mixture selected from the group consisting of natural rubber (NR), epoxidized natural rubber (ENR), isoprene rubber (IR), butadiene rubber (BR), acrylate rubber (ACM), styrene-butadiene rubber (SBR), and mixtures thereof, said rubber mixture containing mixing ingredients selected from the group consisting of fillers, plasticizers, and anti-aging agents;

said elastic intermediate plate having a substantially planar top side, and a bottom side having a surrounding edge and a plurality of protrusions and recesses formed on a surface of said bottom side within the surrounding edge;

said bottom side having a center zone and two side zones, each of said side zones having an identical arrangement of said protrusions and recesses with respect to the other and a different arrangement of said protrusions and recesses with respect to the center zone, the center zone having greater rubber-elastic deformability than the two side zones;

said recesses forming inactive surfaces disposed at a substantially constant depth within each zone, the inactive surfaces within the center zone being disposed deeper than the inactive surfaces within the two side zones;

said protrusions forming active surfaces within each zone, the active surfaces of the protrusions within the center zone having a smaller overall surface area than the protrusions in each side zone; and each side zone having a larger surface area than the center zone.

2. The elastic intermediate plate according to claim 1, wherein the elastic intermediate plate is arranged between the rail base and the hard support without the use of an additional elastic intermediate layer.

3. The elastic intermediate plate according to claim 1, wherein the minimum depth of the inactive surfaces within the two side zones is 3 mm.

4. The elastic intermediate plate according to claim 1, wherein the minimum depth of the inactive surfaces of the center zone is at least 1 mm greater than the depth of the inactive surfaces within the two side zones.

5. The elastic intermediate plate according to claim 1, wherein the elastic intermediate plate has a total thickness of at least 10 mm based on the total height of the surfaces of the protrusions.

6. The elastic intermediate plate according to claim 1, wherein the elastic intermediate plate has a minimum thickness between the inactive surfaces within the center zone and the top side of 2 mm.

7. The elastic intermediate plate according to claim 1, wherein the active surfaces of the protrusions and the surface of the edge form a substantially planar support surface in the unloaded condition.

8. The elastic intermediate plate according to claim 1, wherein the total surface area of the active surfaces of all protrusions within the zones is ≦ than the total surface area of the inactive surfaces of all recesses within the zones.

9. The elastic intermediate plate according to claim 1, wherein the center zone has at least one protrusion not connected with the edge.

10. The elastic intermediate plate according to claim 9, wherein the center zone has four protrusions separated from each other.

11. The elastic intermediate plate according to claim 1, wherein the center zone has two bridge protrusions arranged within the region of a center plane extending in the longitudinal direction of the rail, said protrusions each being connected with the edge.

12. The elastic intermediate plate according to claim 1, wherein the two side zones each have a large base protrusion, said base protrusion being arranged within a center plane extending in the transverse direction of the rail.

13. The elastic intermediate plate according to claim 12, wherein the base protrusion is provided with at least one drain duct extending in the longitudinal and/or transverse directions of the rail, forming a multi-component base protrusion.

14. The elastic intermediate plate according to claim 12, wherein at least one additional protrusion is arranged in each case between the base protrusion and the edge, said additional protrusion not being connected with the edge.

15. The elastic intermediate plate according to claim 14, wherein only one single protrusion is present in each case between the base protrusion and the edge, said single protrusion having its greatest dimension of expanse in the transverse direction of the rail.

16. The elastic intermediate plate according to claim 14, wherein two to three protrusions are present in each case between the base protrusion and the edge, said two to three protrusions being arranged separated from one another.

17. The elastic intermediate plate according to claim 16, wherein the protrusions arranged between the base protrusion and the edge each have about equally sized active surfaces which, in turn, each have about the same size as the active surface of each protrusion present in a center region of the center zone.

18. The elastic intermediate plate according to claim 1, wherein the center zone has a width which, based on the transverse direction of the rail, is smaller than the rail base.

19. The elastic intermediate plate according to claim 1, wherein said rubber mixture contains an amount of rubber ranging from 45 to 75% by weight.

20. The elastic intermediate plate according to claim 1 wherein:

(a) the elastic intermediate plate is provided with two through-extending holes for screws to fasten the rails;

(b) the edge is provided with at least one drain duct extending in the transverse direction of the rails;

(c) the plurality of protrusions and recesses have a substantially mirror-symmetric overall structure with respect to center planes extending in the transverse and longitudinal directions of the rail; and (d) the bottom side rests directly on the hard support.

21. The elastic intermediate plate according to claim 20 wherein:

(a) the rubber mixture is a mixture selected from the group consisting of a natural rubber (NR)/styrene-butadiene rubber (SBR) mixture and a natural rubber/butadiene rubber (BR) mixture;

(b) the minimum depth of the inactive surfaces within the two side zones is 4 mm;

(c) the minimum depth of the inactive surfaces of the center zone is at least 2 mm greater than the depth of the inactive surfaces within the two side zones;

(d) the elastic intermediate plate has a total thickness of 10 to 12 mm based on the total height of the surfaces of the protrusions;

(e) the elastic intermediate plate has a minimum thickness of 3 mm between the inactive surfaces within the center zone and the top side;

(f) said large base protrusion in each of the two side zones is connected with the surrounding edge and provided with a breakthrough for said screws; and (g) said rubber mixture contains an amount of rubber ranging from 55 to 65% by weight.

22. A series mounting assembly comprising an elastic intermediate plate positioned between a rail base and a hard support of a rail track having a plurality of rails, a metal base plate for fastening the rail track, and an elastic intermediate layer positioned above said elastic intermediate plate directly below the rail base and separated from said elastic intermediate plate by said base plate, said elastic intermediate plate comprising:

a single-piece vulcanized material produced from a rubber mixture selected from the group consisting of natural rubber (NR), epoxidized natural rubber (ENR), isoprene rubber (IR), butadiene rubber (BR), acrylate rubber (ACM), styrene-butadiene rubber (SBR), and mixtures thereof, said rubber mixture containing mixing ingredients selected from the group consisting of fillers, plasticizers, and anti-aging agents;

said elastic intermediate plate having a substantially planar top side, and a bottom side having a surrounding edge and a plurality of protrusions and recesses formed on a surface of said bottom side within the surrounding edge;

said bottom side having a center zone and two side zones, each of said side zones having an identical arrangement of said protrusions and recesses with respect to the other and a different arrangement of said protrusions and recesses with respect to the center zone, the center zone having greater rubber-elastic deformability than the two side zones;

said recesses forming inactive surfaces disposed at a substantially constant depth within each zone, the inactive surfaces within the center zone being disposed deeper than the inactive surfaces within the two side zones;

said protrusions forming active surfaces within each zone, the active surfaces of the protrusions within the center zone having a smaller overall surface area than the protrusions in each side zone; and each side zone having a larger surface area than the center zone.

23. The assembly according to claim 22, wherein the elastic intermediate layer has a substantially planar top side, and an underside having a surrounding underside edge and a plurality of protrusions and recesses formed on a surface of said underside within the surrounding underside edge, whereby the recesses forming the inactive surfaces have substantially the same depth everywhere, and whereby, furthermore, the active surfaces of the protrusions and the surface of the underside edge form a substantially planar support surface in the unloaded condition.

24. The assembly according to claim 23, wherein the elastic intermediate layer has a minimum depth of the inactive surfaces of all recesses of 3 mm at a total thickness of at least 7 mm.

25. The assembly according to claim 23, wherein the active surfaces of all protrusions of the elastic intermediate layer is ≧ than the total surface area of the inactive surfaces of all recesses of the elastic intermediate layer.

26. The assembly according to claim 23 wherein the plurality of protrusions and recesses in the elastic intermediate layer has a substantially mirror-symmetric overall structure with respect to center planes extending in the transverse and longitudinal directions of the rails.

27. The assembly according to claim 24 wherein the total thickness of the elastic intermediate layer is smaller than the total thickness of the elastic intermediate plate.

28. The assembly according to claim 22, wherein the elastic intermediate plate has about twice the surface area of the elastic intermediate layer.

29. The assembly according to claim 22, wherein the assembly has a spring stiffness which is always lower than the lowest stiffness of an individual spring.

30. The assembly according to claim 22, wherein the elastic intermediate layer consists of a single-piece vulcanized material.

31. The assembly according to claims 22, wherein the elastic intermediate layer consists of a single-piece vulcanized material based on the same material as the elastic intermediate plate.

* * * * *